United States Patent [19]

Knobel et al.

[11] 3,975,660

[45] Aug. 17, 1976

[54] STARTERLESS LOW-VOLTAGE FLUORESCENT-LAMP CIRCUIT ARRANGEMENTS

[75] Inventors: Fritz Knobel, Ennenda; Ernst Meili, Uster, both of Switzerland

[73] Assignee: F. Knobel Elektro-Apparatebau AG, Ennenda, Switzerland

[22] Filed: Mar. 27, 1975

[21] Appl. No.: 556,535

[30] Foreign Application Priority Data

Mar. 28, 1974 Switzerland ..... 4303/74

[52] U.S. Cl. ..... 315/102; 315/DIG. 5; 315/96

[51] Int. Cl.[2] ..... H05B 41/232

[58] Field of Search ..... 315/102, DIG. 5, 95, 315/96, 104

[56] References Cited

UNITED STATES PATENTS 3,324,349 6/1967 Moerkens et al. ..... 315/102 X

*Primary Examiner*—R. V. Rolinec
*Assistant Examiner*—Darwin R. Hostetter
*Attorney, Agent, or Firm*—Haseltine, Lake & Waters

[57] ABSTRACT

A starterless circuit arrangement for the ignition and the operation of one or a number of series connected, low voltage fluorescent lamps which are connected with a stray field transformer coupled with a voltage source. The stray field transformer produces the no-load voltage needed for firing the lamps and possesses heating coils which are connected with the electrodes of the lamps. A cold conductor having markedly positive resistance characteristic is connected in parallel with at least part of the secondary winding of the stray field transformer in order to maintain the voltage applied to the lamp(s) at a value beneath the firing or ignition voltage for such length of time until the electrodes of the lamps are pre-heated.

5 Claims, 3 Drawing Figures

STARTERLESS LOW-VOLTAGE FLUORESCENT-LAMP CIRCUIT ARRANGEMENTS

BACKGROUND OF THE INVENTION

The present invention relates to a new and improved starterless circuit arrangement for the firing or ignition and the operation of one or a number of series connected, low voltage fluorescent lamps which are connected with a stray field transformer coupled with a voltage source, the stray field transformer generating the no-load or open-circuit voltage required for the ignition of the lamps and possessing heating coils or windings which are connecting with the electrodes of the lamps.

In order to obtain satisfactory longevity of the lamps it is important that prior to the occurrence of the discharge the lamp electrodes are pre-heated to a minimum temperature in the order of about 600°C to 800°C.

As is known the lamp ignition voltage, apart from the proper pre-heating of the electrodes, is furthermore dependent upon many additional factors, such as for instance the ambient temperature, the humidity of the air, the spacing between the lamp and metallic base, the aging condition, the make of the lamps, just to mention a few of the more important factors.

If it is desired to always have sufficient operational reliability, then it is necessary to select the no-load voltage to be so great that even under the most unfavorable operating conditions with a lamp which does not wish to ignite and in the presence of undervoltage there is insured for positive ignition or firing. This has the result that in the case of normal operating conditions with good lamps the ignition occurs without sufficient pre-heating. There thus occur the so-called cold starts which markedly reduce the longevity of the lamps. This dependency of the pre-heating, no-load voltage and lamp longevity is considered to be disadvantageous with the previous starterless circuits.

SUMMARY OF THE INVENTION

Hence, it is a primary object of the present invention to provide an improved starterless circuit arrangement for the firing and operation of one or a number of series connected fluorescent lamps in a manner not associated with the aforementioned drawbacks and limitations.

Another object of the invention is to overcome the above-discussed disadvantages.

Still a further object of the invention is to provide a starterless circuit arrangement of the previously mentioned type which permits of a positive ignition of the lamps without there however occurring the discharge at the time when the lamp electrodes are still cold.

Now in order to implement these and still further objects of the invention which will become more readily apparent as the description proceeds, the circuit arrangement of this development contemplates the provision of a cold conductor having markedly resistance characteristic which is connected in parallel with at least part of the secondary winding of the stray field transformer in order to maintain the voltage applied to the lamp or lamps at a value which is below the ignition voltage for such length of time until the electrodes of the lamps are pre-heated.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
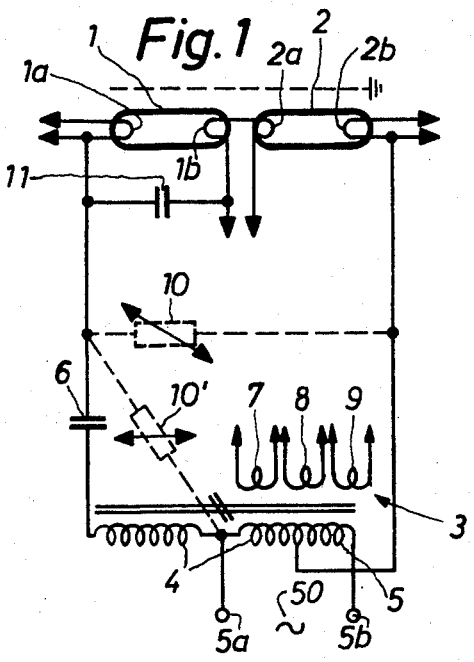
FIG. 1 is a first embodiment of circuit arrangement for the ignition and operation of one or more series connected low voltage fluorescent lamps.

Describing now the drawing, with the exemplary embodiment depicted in FIG. 1 there are provided two series connected, low voltage fluorescent lamps 1 and 2 having electrodes designated by reference characters 1*a*, 1*b* and 2*a*, 2*b* respectively. The electrode 1*a* is connected through the intermediary of a compensation capacitor 6 with the one end of a secondary winding 4 of a stray field transformer 3, and the electrode 2*b* is connected at a tap of such secondary winding 4.

The stray field transformer 3 is constructed as an autotransformer, so that its primary winding 5 forms a part of the secondary winding 4. The primary winding 5 is connected via terminals 5*a*, 5*b* at a schematically indicated voltage source designated by reference character 50.

At the stray field transformer 3 there are provided three heating windings or coils 7, 8 and 9. Respective ones of such heating windings are connected with the electrodes 1*a*, 2*b*; in other words, one heating winding is connected with the electrode 1*a*, another heating winding with the electrode 2*b*, and the remaining third heating winding with the series connected electrodes 1*b* and 2*a*.

In the lamp current circuit there is provided a cold conductor 10 which can be incorporated in different ways into the circuit. As shown in FIG. 1, the cold conductor can be connected parallel to the secondary winding 4 and to the lamps 1 and 2 (as is shown for the cold conductor 10) or else parallel to a series connection of a part of the secondary winding 4 and series capacitor 6 (as is shown for a cold conductor 10'), or furthermore can also be connected only to a part of the secondary winding 4 (which has not been particularly illustrated).

The cold conductor has a markedly positive resistance characteristic. In the cold state it preferably has a resistance of about 50 to 500 ohms and after reaching the breakover temperature a resistance exceeding 20,000 ohms.

Upon switching-in the lamps 1 and 2 the electrodes 1*a*, 1*b* and 2*a*, 2*b* respectively are immediately heated by means of the heating windings 7, 8 and 9. Since the cold conductor 10 in the cold condition is very low-ohmic a relatively large current flows through the current circuit which is formed by the cold conductor 10 and the secondary winding 4 of the stray field transformer 3. Owing to the current-voltage characteristic of the stray field transformer 3 the secondary voltage of the stray field transformer 3 which is applied to the lamps 1 and 2 is small and is below the voltage values required for the ignition of the lamps.

If the cold conductor 10 reaches its breakover or tilt temperature then it suddenly becomes high-ohmic. The secondary voltage of the stray field transformer 3 climbs to a value exceeding the lamp ignition voltage, so that the lamps 1 and 2 fire or ignite.

In the described manner the ignition of the lamps is delayed for such length of time until the electrodes 1*a*, 1*b*, 2*a*, 2*b* are pre-heated to a temperature which amounts to at least 600°C to 800°C.

When connecting the cold conductor parallel to only a part of the secondary winding 4, i.e. to the series connection of a part of the secondary winding 4 and the capacitor 6 (cold conductor 10') then, as above described, the secondary voltage of the stray field transformer is correspondingly reduced as long as the cold conductor has not yet reached its breakover temperature.

The capacitor 11 which is connected parallel to the lamp 1 serves in conventional manner as a starting aid.

It is possible to connect the electrode 2*b* at the end of the secondary winding 4 instead of at a tap.

Figure 2:
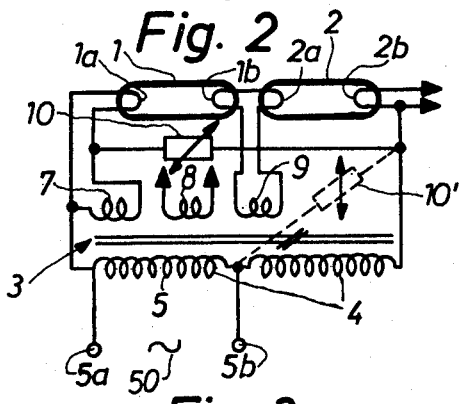
FIG. 2 is a second embodiment of circuit arrangement of the invention.

The exemplary embodiment depicted in FIG. 2 corresponds to that shown in FIG. 1 with the exception of the absence of the series capacitor 6 which has been shown for the embodiment of FIG. 1. Hence, as a matter of convenience the same components have been designated with the same reference character. The cold conductor 19 is connected parallel to the lamps 1, 2 or, at 10' parallel to part of the secondary winding.

Figure 3:
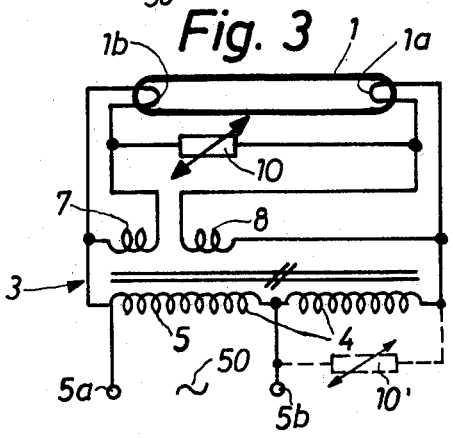
FIG. 3 is a third embodiment of circuit arrangement according to the invention.

With the embodiment depicted in FIG. 3 there is only provided a single low voltage fluorescent lamp 1 which is electrically coupled in an economy circuit with the secondary winding 4 of the stray field transformer 3. the electrodes 1*a*, 1*b* are electrically connected with the heating windings or coils 7, 8 of the transformer 3. The primary winding 5 of the transformer 3 is connected by means of the terminals 5*a* and 5*b* with the schematically indicated voltage source or supply, designated by reference character 50. Connected in parallel with the lamp 1 or with a part of the secondary winding 4 is the cold conductor 10 or 10' respectively. The mode of operation of this circuit corresponds to that of the circuit according to the showing of FIG. 1.

By means of the cold conductor 10, in the cold state the secondary voltage of the stray field transformer and the voltage across the lamp or lamps is reduced to such an extent that the lamp or lamps do not ignite. Consequently, with all of the exemplary embodiments the occurrence of the discharge is delayed for such length of time until the lamp electrodes are sufficiently preheated.

While it is indeed advantageous to construct the stray field transformer as an auto-transformer this is by no means absolutely necessary. The stray field transformer can also be of conventional construction having separate primary and secondary windings.

Since the cold conductor is not located in the heating current circuit of the electrodes and therefore does not serve to maintain the heating-up temperature of the electrodes, hence the requirements placed upon the response behavior of the cold conductor are not very strict.

In the described circuits there have been omitted for the sake of clarity in illustration any possibly required disturbance protection capacitors and/or ignition assistance capacitors.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. A starterless circuit arrangement for the ignition and operation of at least one low-voltage fluorescent lamp in a series connection, comprising in combination: at least one fluorescent lamp connected in circuit with a stray-field transformer, a voltage source, said transformer being connected to said source, and generating a no-load voltage required for the ignition of said lamp, the latter having electrode means, said transformer being provided with at least one heating winding connected with said electrode means, and with a secondary winding, a cold conductor possessing markedly positive resistance characteristics, connected in parallel with at least part of said secondary winding in order to maintain the voltage applied to said lamp at a value beneath the ignition voltage, for such length of time until said electrode means are pre-heated.

2. The starterless circuit arrangement as defined in claim 1, wherein said cold conductor is connected in parallel with said at least one fluorescent lamp.

3. The starterless circuit arrangement as defined in claim 1, further comprising a capacitor in a series circuit with said secondary winding, said cold conductor being connected in parallel to the series circuit of said capacitor and at least part of said secondary winding.

4. The starterless circuit arrangement as defined in claim 1, comprising two of said fluorescent lamps that are in the series connection, and in the circuit with said stray-field transformer.

5. The starterless circuit arrangement as defined in claim 4, comprising two of said heating windings in said strayfield transformer, one for each of said two fluorescent lamps.

* * * * *